US012078408B2

(12) United States Patent
Alanis et al.

(10) Patent No.: US 12,078,408 B2
(45) Date of Patent: Sep. 3, 2024

(54) REFRIGERATOR AND MULLION FOR A REFRIGERATOR

(71) Applicant: WHIRLPOOL CORPORATION, Benton Harbor, MI (US)

(72) Inventors: Nancy Alanis, Monterrey (MX); Kapil Ayyawar, Milpitas, CA (US)

(73) Assignee: Whirlpool Corporation, Benton Harbor, MI (US)

( * ) Notice: Subject to any disclaimer, the term of this patent is extended or adjusted under 35 U.S.C. 154(b) by 22 days.

(21) Appl. No.: 17/974,147

(22) Filed: Oct. 26, 2022

(65) Prior Publication Data

US 2024/0142160 A1 May 2, 2024

(51) Int. Cl.
*F25D 23/02* (2006.01)

(52) U.S. Cl.
CPC ..... *F25D 23/028* (2013.01); *F25D 2323/021* (2013.01)

(58) Field of Classification Search
CPC ..... F25D 2323/021; F25D 23/028; F25D 2323/024; F25D 23/087; F25D 23/02; F25D 2400/06; E05Y 2900/31
See application file for complete search history.

(56) References Cited

U.S. PATENT DOCUMENTS 5,411,328 A * 5/1995 You ..... F25D 23/028 312/405
9,134,062 B2 * 9/2015 Jung ..... F25D 23/087
9,157,676 B2 10/2015 Lee et al.
9,234,695 B1 1/2016 Dubina et al.
9,890,991 B2 2/2018 Gomes et al.
10,267,554 B2 4/2019 Reuter et al.
10,837,695 B2 11/2020 Baum et al.
2013/0241386 A1* 9/2013 Kim ..... F25D 23/00 312/236
2014/0159560 A1* 6/2014 Jung ..... F25D 23/02 312/405
2016/0146528 A1* 5/2016 Yoon ..... F25D 23/028 62/277
2018/0010845 A1* 1/2018 Kim ..... E06B 3/367
(Continued)

FOREIGN PATENT DOCUMENTS

CN 111503967 A 8/2020
CN 114136040 A * 3/2022
(Continued)

*Primary Examiner* — Hiwot E Tefera
(74) *Attorney, Agent, or Firm* — Brooks Kushman P.C.

(57) ABSTRACT

A refrigerator appliance includes a cabinet, a first door, a second door, a mullion, and a lock. The cabinet defines an internal cavity. The first and second doors are configured to transition between open and closed positions. The mullion is secured to an edge of the first door and is configured to transition between active and inactive positions. In the active position the mullion is configured to span a gap between the first and second doors. In the inactive position the mullion is retracted away from an edge of the first door. The lock is configured to, in response to the first door transitioning to the respective open position, activate and lock the mullion in the inactive position. The lock is configured to, in response to the first door transitioning to the respective closed position, deactivate and unlock the mullion such that mullion transitions to the active position.

17 Claims, 6 Drawing Sheets

(56) References Cited

U.S. PATENT DOCUMENTS

| | | | | |
|---|---|---|---|---|
| 2018/0209209 | A1* | 7/2018 | Ham | E06B 7/215 |
| 2019/0024964 | A1* | 1/2019 | Gwon | F25D 23/028 |
| 2020/0363122 | A1* | 11/2020 | Park | F25D 23/025 |
| 2021/0310289 | A1* | 10/2021 | Bo | E05D 11/06 |
| 2021/0364220 | A1* | 11/2021 | Choi | E05F 1/12 |

FOREIGN PATENT DOCUMENTS

| | | | | |
|---|---|---|---|---|
| KR | 20150003642 | A | * | 1/2015 |
| KR | 20190086844 | A | * | 7/2019 |
| KR | 20210036216 | A | * | 4/2021 |
| WO | WO-2021201468 | A1 | * | 10/2021 |

* cited by examiner

REFRIGERATOR AND MULLION FOR A REFRIGERATOR

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes a cabinet, a first door, a second door, a mullion, a cam block, a cam, and a lock. The cabinet defines an internal cavity configured to store food stuffs. The first and second doors are configured to transition between open and closed positions, cover an opening to the internal cavity in the closed positions, and provide access to the internal cavity via the opening in the open positions. The mullion is secured to an edge of the first door. The mullion is configured to transition between active and inactive positions. In the active position the mullion is configured to provide a seal and span a gap between the first and second doors while the first and second doors are in the closed positions. In the inactive position the mullion is retracted away from the edge of the first door to provide clearance along the edge of the first door while the first door is in the respective open position. The cam block is disposed on the cabinet along the opening and defines a cammed slot. The cam is secured to the mullion. The cam is configured to engage the cammed slot and transition the mullion to the active position in response to closing the first door. The cam is configured to disengage the cammed slot and transition the mullion to the inactive position in response to opening the first door. The lock is configured to, in response to the first door transitioning to the respective open position and the cam disengaging the cammed slot, activate and lock the mullion in the inactive position. The lock is configured to, in response to the first door transitioning to the closed position and the cam engaging the cammed slot, deactivate and unlock the mullion such that mullion transitions to the active position.

A refrigerator appliance includes a cabinet, a first door, a second door, a mullion, and a lock. The cabinet defines an internal cavity. The first and second doors are configured to transition between open and closed positions. The mullion is secured to an edge of the first door and is configured to transition between active and inactive positions. In the active position the mullion is configured to span a gap between the first and second doors. In the inactive position the mullion is retracted away from an edge of the first door. The lock is configured to, in response to the first door transitioning to the respective open position, activate and lock the mullion in the inactive position. The lock is configured to, in response to the first door transitioning to the respective closed position, deactivate and unlock the mullion such that mullion transitions to the active position.

A refrigerator includes a door, a mullion, a cam, and a lock. The door is configured to transition between and open and closed positions. The mullion is secured to an edge of the door and is configured to pivot between active and inactive positions. The cam protrudes from the mullion, is configured to engage a cammed slot to transition the mullion to the active position in response to closing the door, and is configured to disengage the cammed slot to transition the mullion to the inactive position in response to opening the first door. The lock is configured to, in response to the cam disengaging the cammed slot, activate and lock the mullion in the inactive position. The lock is configured to, in response to the cam engaging the cammed slot, deactivate and unlock the mullion.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
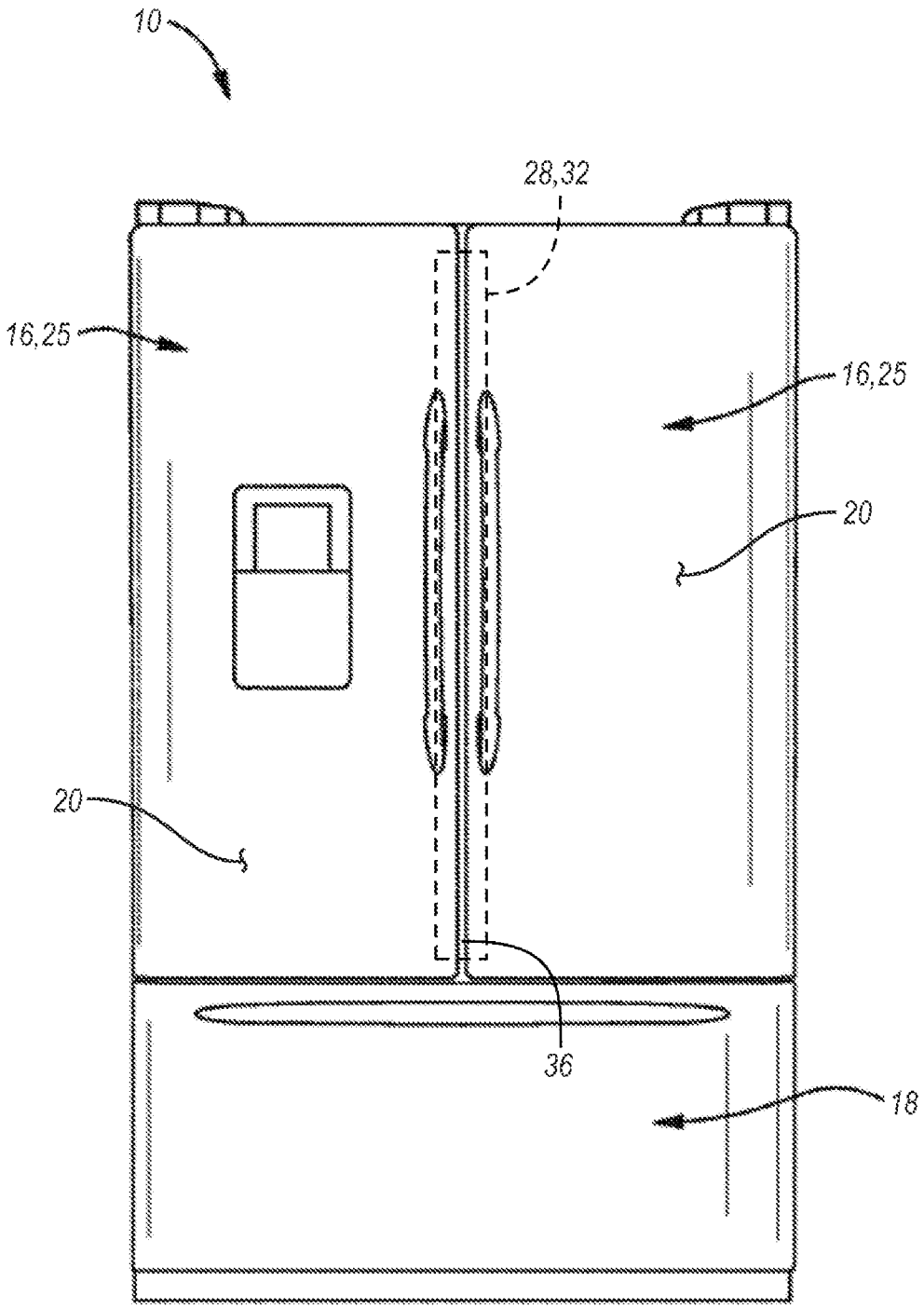
FIG. 1 is an elevated front view of a French-Door Bottom Mount type refrigerator appliance.
Figure 2:
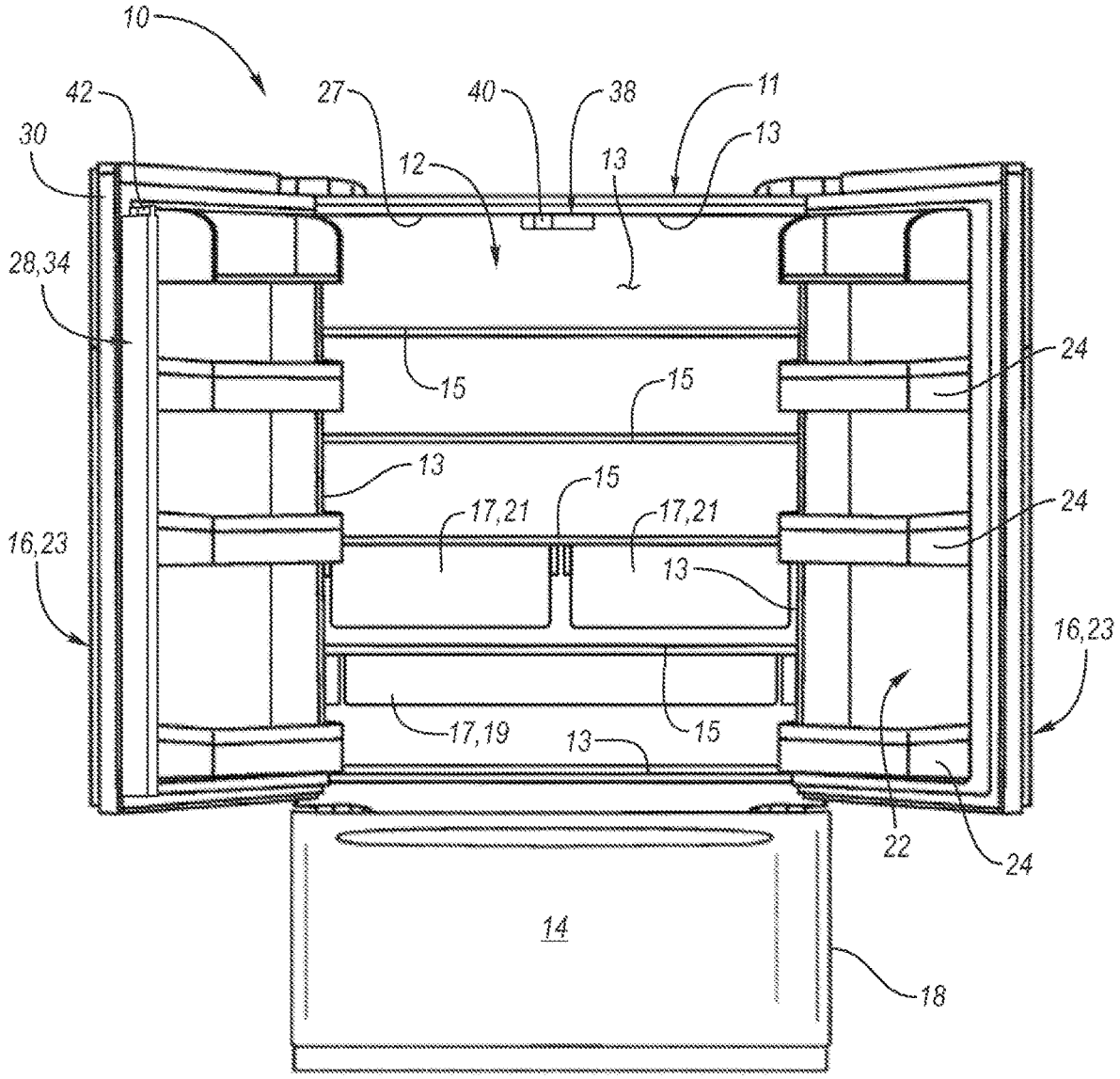
FIG. 2 is an elevated front view of a French-Door Bottom Mount type refrigerator with the refrigerator compartment doors open.
Figure 4:
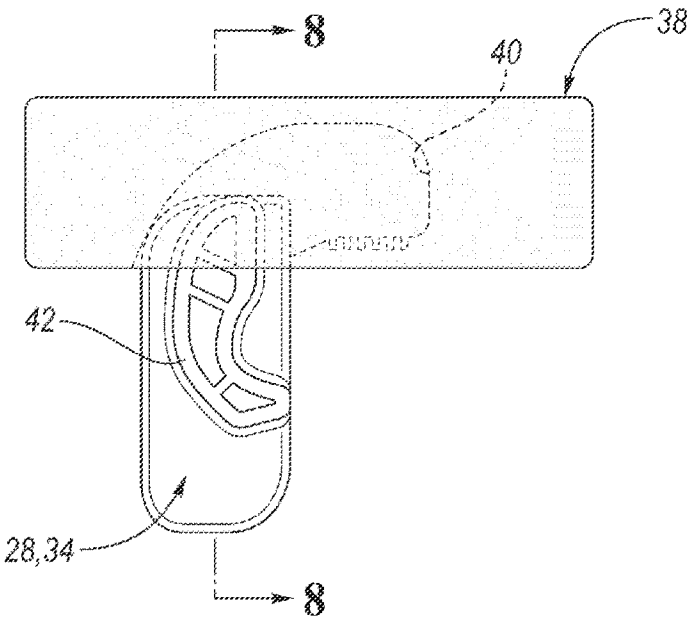
FIGS. 4 and 5 illustrate the engagement between a cam that is attached to the mullion and a cam block that is secured to a cabinet of the refrigerator.
Figure 5:
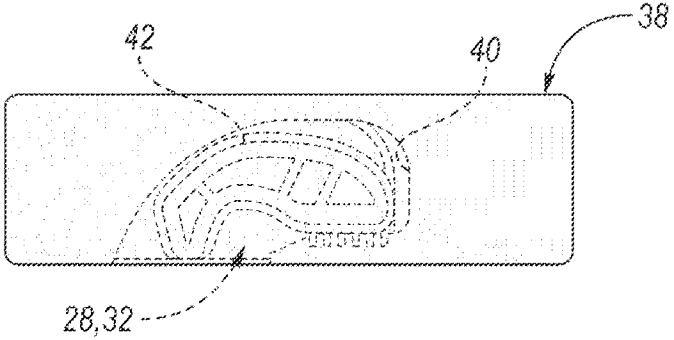
Figure 3:
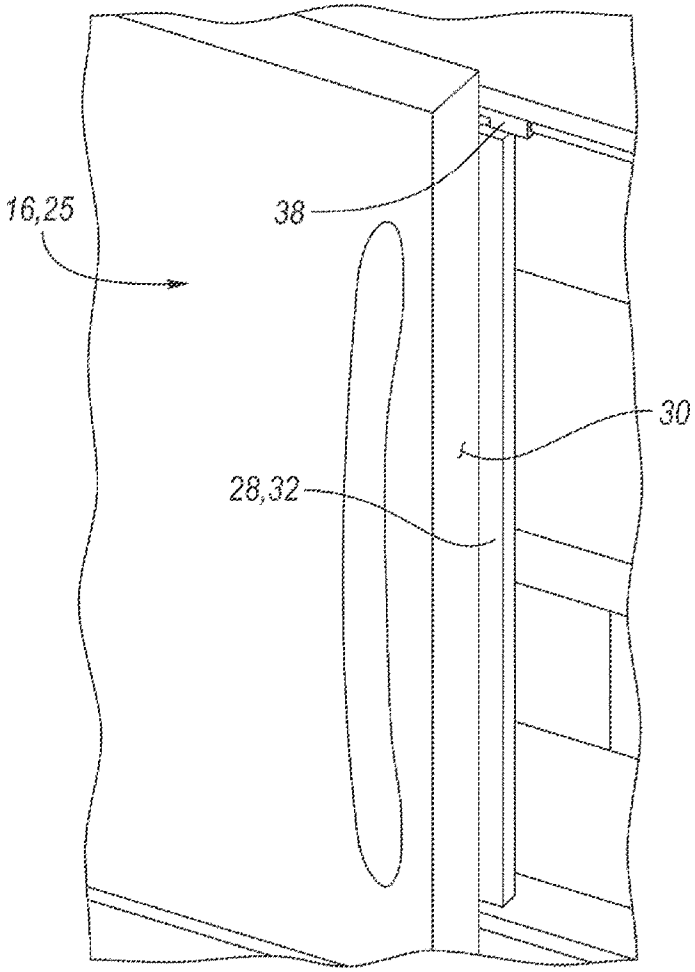
FIG. 3 is a partial view of the refrigerator illustrating one of the doors and a mullion that is attached to the door.
Figure 6:
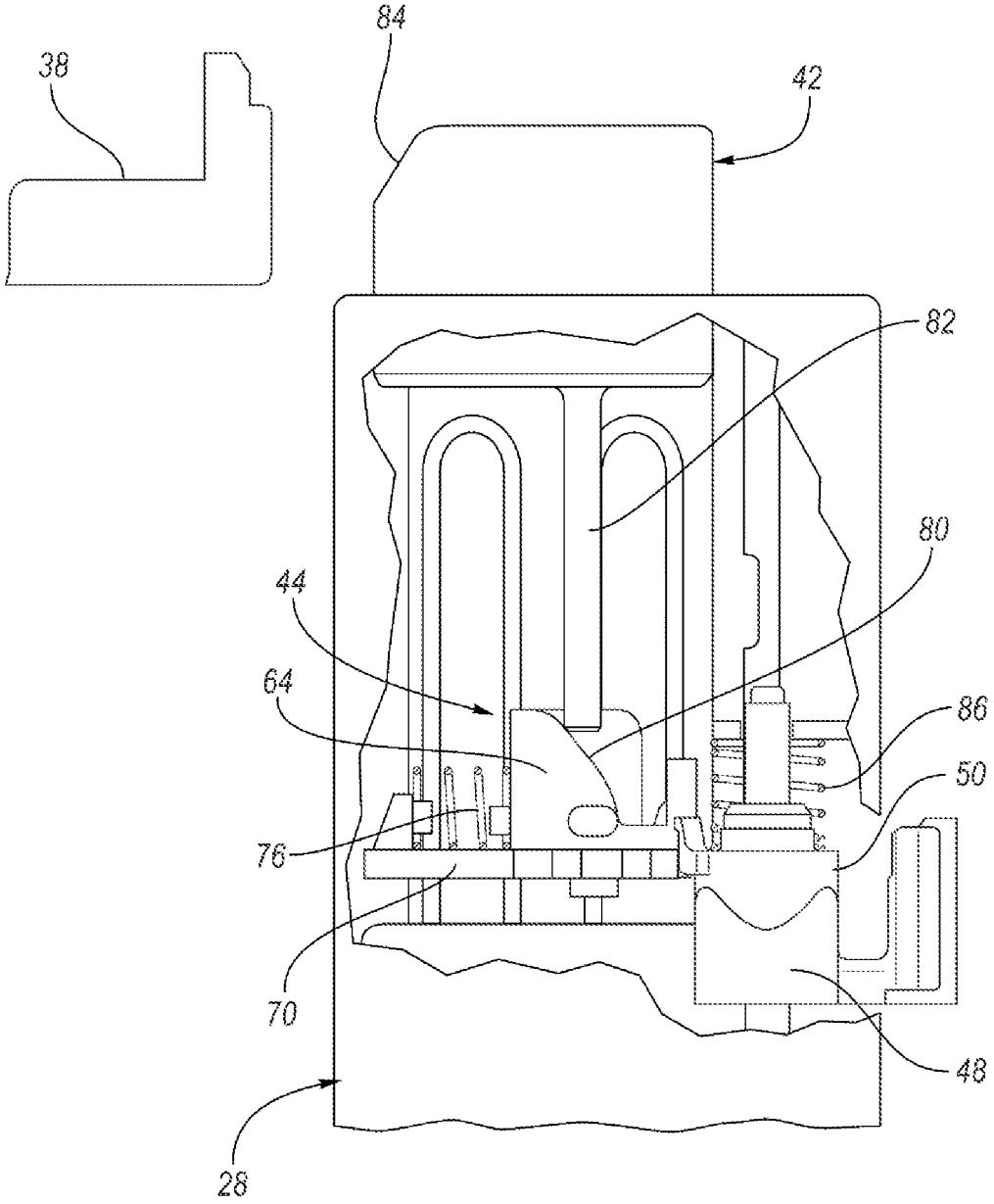
FIG. 6 is a cutaway view of an upper portion of the mullion illustrating a lock that is configured to lock the mullion in an inactive position.
Figure 7:
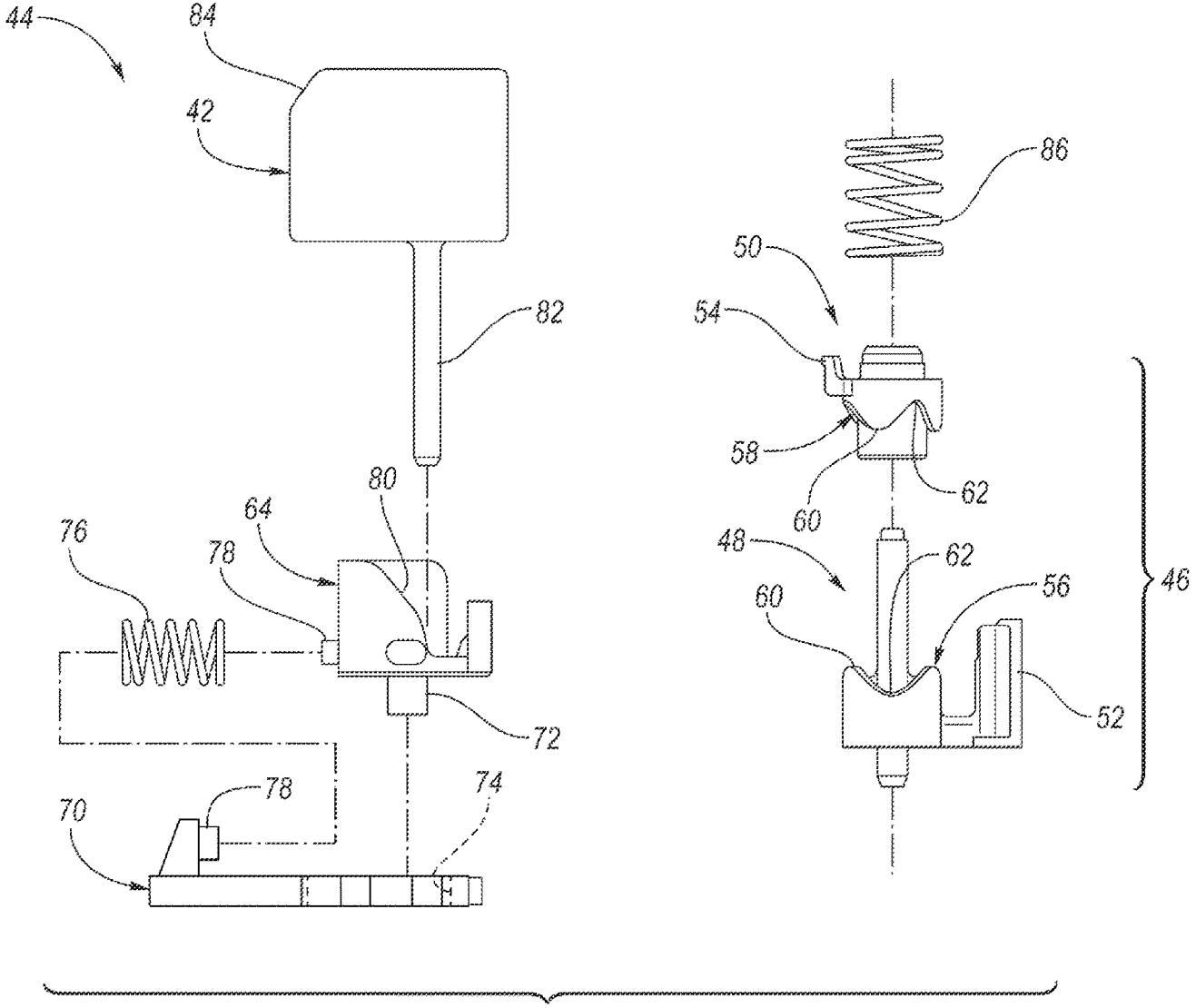
FIG. 7 is an exploded view of the lock.
Figure 9:
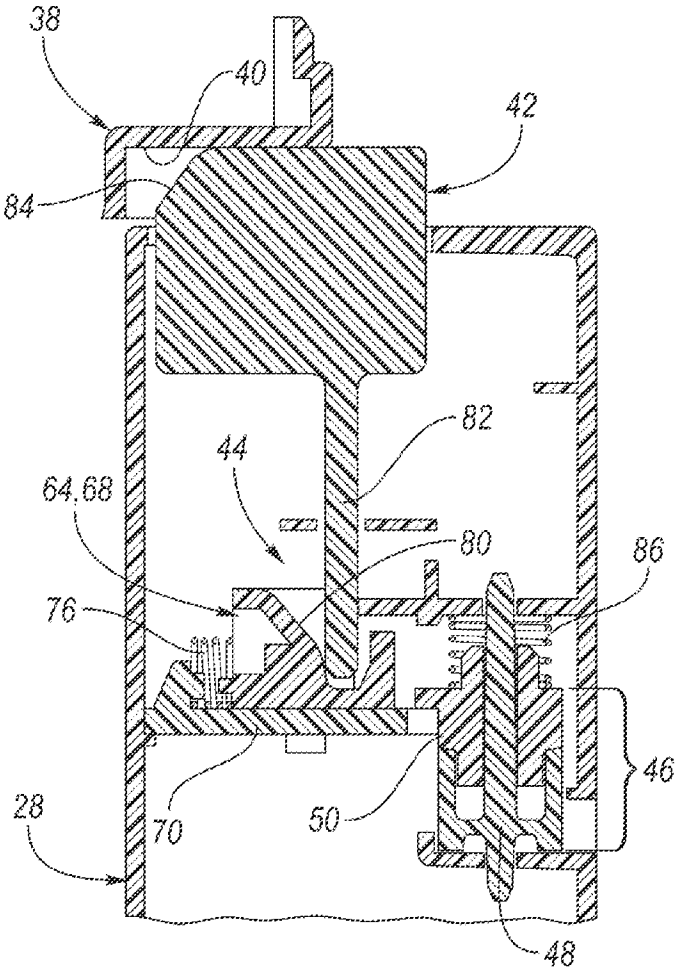
FIG. 9 is a cross-sectional view of the upper portion of the mullion and the cam block taken along 8-8 of FIG. 4 illustrating the lock in a deactivated condition.
Figure 8:
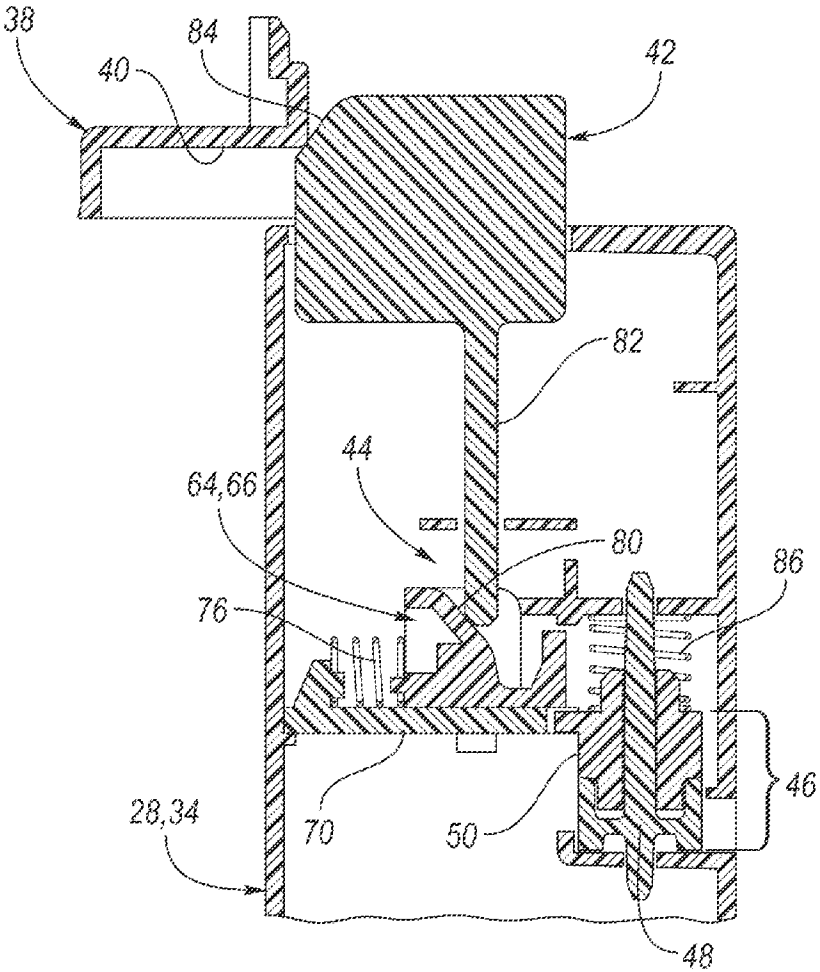
FIG. 8 is a cross-sectional view of the upper portion of the mullion and the cam block taken along 8-8 of FIG. 4 illustrating the lock in an activated condition.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a cabinet 11 or housing defining a first internal storage chamber, internal cavity, or fresh food compartment 12 configured to refrigerate and not freeze consumables or foodstuffs within the fresh food compartment 12, and a second internal storage chamber, internal cavity, or a freezer compartment 14 configured to freeze consumables or foodstuffs within the freezer compartment 14 during normal use. The refrigerator 10 includes panels or walls 13 that form the cabinet 11 or housing and define the fresh food compartment 12 and the freezer compartment 14. The walls 13 may more specifically form an internal liner of the refrigerator 10. The walls 13 may include a rear or back wall, a top wall, a bottom wall, and two side walls.

One or more shelves 15 may be secured to the walls 13 within the fresh food compartment 12. One or more drawers 17 may be slidably secured to the shelves 15 or the walls within the fresh food compartment 12. More specifically, the drawers 17 may be slidably secured to the shelves 15 or the walls within the fresh food compartment 12 via tracks or rails. One or more of the drawers 17 may be either a pantry drawer 19 or a crisper drawer 21. Crisper drawer 21 may more specifically be drawers defining a storage space that is kept at a desired humidity that may be different from the remainder of the fresh food compartment 12, but that is optimal for maintaining freshness of fruits and vegetables.

The refrigerator 10 may have one or more doors 16, 18 that provide selective access to the interior volume of the refrigerator 10 where consumables may be stored. As shown, the fresh food compartment doors are designated 16, and the freezer door is designated 18. The doors 16 may be configured to transition between open positions 23 and closed positions 25. The doors 16 may cover an opening 27 to the internal cavity (e.g., fresh food compartment 12) in the closed positions 25. The doors 16 may provide access to the internal cavity via the opening 27 in the open positions 23. It may also be shown that the fresh food compartment 12 may only have one door 16 as opposed to two doors 16 as illustrated. The doors 16 may be rotatably secured to the cabinet 11 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food compartment 12 when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Referring to FIGS. 1-5, a mullion 28 and associated components are illustrated. The mullion 28 is secured to an edge 30 of a first of the doors 16. More specifically, the mullion 28 may be rotatably or pivotably secured to the first of the doors 16. The mullion 28 is configured to transition between an active position 32 and an inactive position 34. In the active position 32 the mullion 28 is configured to provide a seal and span a gap 36 defined between the first and the second of the doors 16 while the first and the second of the doors 16 are in the closed positions 25. More specifically, the mullion 28 provides a seal along the gap 36 between the internal cavity (e.g., fresh food compartment 12) and the exterior of the refrigerator 10 (e.g., the ambient surroundings around the refrigerator 10). In the inactive position 34 the mullion is rotated or retracted away from the edge 30 of the first of the doors 16 to provide clearance along the edge 30 of the first of the doors 16 while the first of the doors 16 is in the respective open position 23.

A pivot block or cam block 38 is disposed on the cabinet 11 along the opening 27. The cam block 38 defines a cammed slot 40 that is configured to guide and direct the path of object, such as a cam, that is entering or exiting the cammed slot 40. A cam 42 is attached or secured to the mullion 28. More specifically, the cam 42 may protrude from the mullion 28. Even more specifically, the cam 42 may protrude upward from the mullion 28. The cam 42 is configured to engage the cammed slot 40 and transition the mullion 28, or more specifically rotate the mullion 28, to the active position 32 in response to closing the first of the doors 16. The cam 42 is configured to disengage the cammed slot 40 and transition the mullion 28, or more specifically rotate the mullion 28, to the inactive position 34 in response to opening the first of the doors 16. The cam 42 may be referred to as the pivot cam.

Referring to FIGS. 6-9, a lock 44 that is configured to lock the mullion 28 in the inactive position 34 is illustrated. The lock 44 is configured to, in response to the first of the doors 16 transitioning to the respective open position 23 and the cam 42 disengaging the cammed slot 40, activate and lock the mullion 28 in the inactive position 34. The lock 44 is also configured to, in response to the first of the doors 16 transitioning to the closed 25 position and the cam 42 engaging the cammed slot 40, deactivate and unlock the mullion 28 such that mullion 28 transitions to the active position 32.

A hinge 46 rotatably or pivotably secures the mullion 28 to the first of the doors 16 such that mullion 28 rotates between the active position 32 and the inactive position 34 about the hinge 46 relative to the first of the doors 16. The hinge 46 includes a pin 48 that is secured to the first of the doors 16 and a bushing 50 that secured to the mullion 28. The bushing 50 is configured to rotate about the pin 48, which in turn causes rotation of the mullion 28 relative to the first of the doors 16. The pin 48 includes a protrusion 52 that engages the first of the doors 16 to prevent relative rotation between the pin 48 and the first of the doors 16. The bushing 50 includes a protrusion 54 that engages the mullion 28 to prevent relative rotation between the bushing and the mullion 28.

The pin 48 includes a first cammed surface 56 and the bushing includes a second cammed surface 58. The second cammed surface 58 moves along the first cammed surface 56 when the bushing 50 rotates relative to the pin 48. More specifically, the second cammed surface 58 moves along the first cammed surface 56 when the mullion 28 rotates relative to the first of the doors 16 via the bushing 50 rotating relative to the pin 48. The engagement between the second cammed surface 58 and the first cammed surface 56 may result in a change in the relative heights between the pin 48 and the bushing 50 due to the shape (e.g., sine wave shapes) of the second cammed surface 58 and the first cammed surface 56. The pin 48 may be referred to as the lower mullion cam while the bushing 50 may be referred to as the upper mullion cam.

Engagement between the second cammed surface 58 and the first cammed surface 56 may operate as a clutch. Therefore, the second cammed surface 58 and the first cammed surface 56 may collectively be referred to as a clutch. The said clutch formed by the second cammed surface 58 and the first cammed surface 56 is configured to (i) transition to a closed condition to restrict relative to rotation between the pin and the bushing and (ii) transition to an open condition to enable relative to rotation between the pin and the bushing. The second cammed surface 58 and the first cammed surface 56 each include hills 60 and valleys 62. When the hills 60 and valleys 62 of the second cammed surface 58 are able to freely move to engage either the hills 60 or valleys 62 of the first cammed surface 56, the clutch may be said to be in an open condition. When the hills 60 of the second cammed surface 58 are trapped within the valleys 62 of the first cammed surface 56 and when the hills 60 of the first cammed surface 56 are trapped within the valleys 62 of the second cammed surface 58, the clutch may be said to be in a closed condition.

In response to activating the lock 44, the clutch formed by the second cammed surface 58 and the first cammed surface 56 is engaged to lock the said clutch in the closed condition such that the said clutch (i) restricts relative rotation between the pin 48 and the bushing 50 and (ii) locks the mullion 28 in the inactive position 34. In response to deactivating the lock 44, the clutch formed by the second cammed surface 58 and the first cammed surface 56 is disengaged to unlock the said clutch such that the said clutch may transition between the open and closed conditions.

The lock 44 includes a slide 64 that is configured to transition between a first position 66 and a second position 68. The slide 64 is configured to slide between the first position 66 and the second position 68 on a slide support 70. More specifically, the slide 64 has a downward extending protrusion 72, the slide support defines a slot 74, and the downward extending protrusion 72 is disposed within and slidable within the slot 74 to guide the slide 64 between the first position 66 and the second position 68. The slide 64 may be referred to as the mullion slide and the slide support 70 may be referred to as the mullion slide support.

The slide 64 is configured to engage the clutch formed by the second cammed surface 58 and the first cammed surface 56 to lock the said clutch in the closed condition when the slide 64 is in the first position 66. More specifically, the slide 64 is disposed on top of the bushing 50 when in the slide 64 is in the first position 66, which prevents the bushing 50 from moving upward. This traps the hills 60 of the second cammed surface 58 within the valleys 62 of the first cammed surface 56 and traps the hills 60 of the first cammed surface 56 within the valleys 62 of the second cammed surface 58, forcing and maintaining the said clutch formed by the second cammed surface 58 and the first cammed surface 56 into and in the closed condition.

The slide 64 is configured to disengage the clutch formed by the second cammed surface 58 and the first cammed surface 56 to unlock the said clutch when the slide 64 is in the second position 68. More specifically, the slide 64 is no longer disposed on top of the bushing 50 when in the slide 64 is in the second position 68 so that the bushing 50 may freely move upward and therefore rotate about the pin 48. The hills 60 of the second cammed surface 58 are no long trapped within the valleys 62 of the first cammed surface 56 and the hills 60 of the first cammed surface 56 are no longer trapped within the valleys 62 of the second cammed surface 58 so that the said clutch may freely transition between the open and closed conditions.

A first biasing element 76, such as a spring, may be configured to bias the slide 64 toward the first position 66. The first biasing element 76 may disposed between the slide 64 and the slide support 70. The slide 64 and slide support 70 may each include posts 78 that locate and retain the first biasing element 76.

The slide 64 includes a first ramped surface 80 and the cam 42 includes a follower 82 that protrudes downward from the cam 42. The cam 42 includes a second ramped surface 84 that engages the cam block 38 when the cam 42 is directed into the cammed slot 40. The follower 82 is configured to engage the first ramped surface 80 to transition the slide between the first position 66 and the second position 68. More specifically, (i) in response to the second ramped surface 84 engaging the cam block 38 and the cam 42 engaging the cammed slot 40, the cam 42 and the follower 82 are forced downward such that the follower 82 advances and engages the first ramped surface 80 to transition slide 64 to the second position 68 so that the clutch formed by the second cammed surface 58 and the first cammed surface 56 is unlocked so that the mullion 28 may rotate via the hinge 46, and (ii) in response to the second ramped surface 84 disengaging the cam block 38 and the cam 42 disengaging the cammed slot 40, the first biasing element 76 biases the slide into the first position 66 so that the clutch formed by the second cammed surface 58 and the first cammed surface 56 is locked in order to lock the mullion 28 in the inactive position 34. The follower 82 may also retract upward from the slide 64 in response to the second ramped surface 84 disengaging the cam block 38 and the cam 42 disengaging the cammed slot 40.

The cam 42 protrudes upward from the mullion 28 and may slide up and down relative to the mullion 28 during an engagement with the cam block 38. However, the cam 42 may protrude through an orifice defined along the top of the mullion 28 that has a matching profile so that, although the cam 42 may slide up and down relative to the mullion 28, the cam 42 and matching profile of the orifice along the top of the mullion 28 restrict the cam 42 and mullion 28 such that the cam 42 and mullion 28 rotate together relative to the first of the doors 16 about the hinge 46. Stated in other terms, the cam 42 and the orifice defined along the top of the mullion 28 function in a manner similar to a key engaging a keyhole.

A second biasing element 86, such as a spring, may be configured to bias the clutch formed by the second cammed surface 58 and the first cammed surface 56 toward the closed condition. The biasing element may be sized to produce a force large enough to maintain contact between the second cammed surface 58 and the first cammed surface 56 but small enough to allow relative rotation between the pin 48 and bushing to allow the mullion 28 to transition between the active position 32 and the inactive position 34.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a cabinet defining an internal cavity configured to store food stuffs;

first and second doors (i) configured to transition between open and closed positions, (ii) cover an opening to the internal cavity in the closed positions, and (iii) provide access to the internal cavity via the opening in the open positions;

a mullion (i) secured to an edge of the first door and (ii) configured to transition between active and inactive positions, wherein (a) in the active position the mullion is configured to provide a seal and span a gap between the first and second doors while the first and second doors are in the closed positions and (b) in the inactive position the mullion is retracted away from the edge of the first door to provide clearance along the edge of the first door while the first door is in the respective open position;

a cam block (i) disposed on the cabinet along the opening and (ii) defining a cammed slot;

a cam (i) secured to the mullion, (ii) configured to engage the cammed slot and transition the mullion to the active position in response to closing the first door, and (iii) configured to disengage the cammed slot and transition the mullion to the inactive position in response to opening the first door;

a lock configured to (i) in response to the first door transitioning to the respective open position and the cam disengaging the cammed slot, activate and lock the mullion in the inactive position and (ii) in response to the first door transitioning to the closed position and the cam engaging the cammed slot, deactivate and unlock the mullion such that mullion transitions to the active position;

a hinge pivotably securing the mullion to the first door such that mullion rotates between the active and inactive positions about the hinge, wherein the hinge includes a pin and a bushing that is configured to rotate about the pin;

a clutch configured to (i) transition to a closed condition to restrict relative to rotation between the pin and the bushing and (ii) transition to an open condition to enable relative to rotation between the pin and the bushing, wherein the lock is configured to, in response to activating the lock, engage the clutch to lock the clutch in the closed condition such that the clutch (i) restricts relative rotation between the pin and the bushing and (ii) locks the mullion in the inactive position, and in response to deactivating the lock, disengage the clutch to unlock the clutch such that the clutch may transition between the open and closed conditions;

a slide forming a portion of the lock, wherein the slide is configured to (i) transition between first and second positions, (ii) engage the clutch to lock the clutch in the closed condition in the first position, and (iii) disengage the clutch to unlock the clutch in the second position, and wherein the slide includes a ramped surface and the cam includes a follower that engages the ramped surface to transition the slide between the first and second positions; and a biasing element that biases the slide toward the first position; wherein the slide is configured to transition between the first and second positions in a direction that is orthogonal to a direction of engagement of the clutch.

2. The refrigerator appliance of claim 1, wherein (i) in response to the cam engaging the cammed slot, the follower advances and engages the ramped surface to transition slide to the second position and (ii) in response to the cam disengaging the cammed slot, the biasing element biases the slide into the first position and the follower retracts.

3. The refrigerator appliance of claim 1 further comprising a second biasing element that biases the clutch toward the closed condition.

4. The refrigerator appliance of claim 1, wherein the clutch is disposed radially about the pin.

5. The refrigerator appliance of claim 1, wherein the clutch comprises opposing cammed surfaces.

6. A refrigerator appliance comprising:

a cabinet defining an internal cavity;

first and second doors (i) configured to transition between open and closed positions;

a mullion (i) secured to an edge of the first door and (ii) configured to transition between active and inactive positions, wherein (a) in the active position the mullion is configured to span a gap between the first and second doors and (b) in the inactive position the mullion is retracted away from an edge of the first door;

a lock configured to (i) in response to the first door transitioning to the respective open position, activate and lock the mullion in the inactive position and (ii) in response to the first door transitioning to the respective closed position, deactivate and unlock the mullion such that mullion transitions to the active position;

a hinge pivotably securing the mullion to the first door such that mullion rotates between the active and inactive positions about the hinge, wherein the hinge includes a pin and a bushing that is configured to rotate about the pin;

a clutch that is configured to (i) transition to a closed condition to restrict relative to rotation between the pin and the bushing and (ii) transition to an open condition to enable relative to rotation between the pin and the bushing, wherein the lock is configured to, in response to activating the lock, engage the clutch to lock the clutch in the closed condition such that the clutch (i) restricts relative rotation between the pin and the bushing and (ii) locks the mullion in the inactive position, and in response to deactivating the lock, disengage the clutch to unlock the clutch such that the clutch may transition between the open and closed conditions; and a slide forming a portion of the lock, wherein the slide is configured to (i) transition between first and second positions, (ii) engage the clutch to lock the clutch in the closed condition in the first position, and (iii) disengage the clutch to unlock the clutch in the second position, and wherein the slide includes a ramped surface and a cam that is secured to the mullion includes a follower that engages the ramped surface to transition the slide between the first and second positions; wherein the slide is configured to transition between the first and second positions in a direction that is orthogonal to a direction of engagement of the clutch.

7. The refrigerator appliance of claim 6, wherein the clutch is disposed radially about the pin.

8. The refrigerator appliance of claim 6, wherein the clutch comprises opposing cammed surfaces.

9. The refrigerator appliance of claim 8, wherein the opposing cammed surfaces include alternating hills and valleys.

10. The refrigerator appliance of claim 6 further comprising a biasing element that biases the slide toward the first position.

11. The refrigerator appliance of claim 6 further comprising a biasing element that biases the clutch toward the closed condition.

12. A refrigerator comprising:

a door configured to transition between and open and closed positions;

a mullion secured to an edge of the door and (ii) configured to pivot between active and inactive positions;

a cam (i) protruding from the mullion, (ii) configured to engage a cammed slot to transition the mullion to the active position in response to closing the door, and (iii) configured to disengage the cammed slot to transition the mullion to the inactive position in response to opening the door;

a lock configured to (i) in response to the cam disengaging the cammed slot, activate and lock the mullion in the inactive position and (ii) in response to the cam engaging the cammed slot, deactivate and unlock the mullion;

a hinge pivotably securing the mullion to the door such that mullion rotates between the active and inactive positions about the hinge, wherein the hinge includes a pin and a bushing that is configured to rotate about the pin;

a clutch configured to (i) transition to a closed condition to restrict relative to rotation between the pin and the bushing and (ii) transition to an open condition to enable relative to rotation between the pin and the bushing, wherein the lock is configured to, in response to activating the lock, engage the clutch to lock the clutch in the closed condition such that the clutch (i) restricts relative rotation between the pin and the bushing and (ii) locks the mullion in the inactive position, and in response to deactivating the lock, disengage the clutch to unlock the clutch such that the clutch may transition between the open and closed conditions; and a slide forming a portion of the lock, wherein the slide is configured to (i) transition between first and second positions, (ii) engage the clutch to lock the clutch in the closed condition in the first position, and (iii) disengage the clutch to unlock the clutch in the second position, and wherein the slide includes a ramped surface and the cam includes a follower that engages the ramped surface to transition the slide between the first and second positions; wherein the slide is configured to transition between the first and second positions in a direction that is orthogonal to a direction of engagement of the clutch.

13. The refrigerator of claim 12, wherein the clutch is disposed radially about the pin.

14. The refrigerator of claim 12, wherein the clutch comprises opposing cammed surfaces.

15. The refrigerator of claim 14, wherein the opposing cammed surfaces include alternating hills and valleys.

16. The refrigerator of claim 12 further comprising a biasing element that biases the slide toward the first position.

17. The refrigerator of claim 12 further comprising a biasing element that biases the clutch toward the closed condition.

* * * * *